US005088955A

United States Patent [19]

Ishimoto

[11] Patent Number: 5,088,955

[45] Date of Patent: Feb. 18, 1992

[54] SOUND EFFECT DEVICE FOR RADIO CONTROLLABLE TOY VEHICLE

[75] Inventor: Zenichi Ishimoto, Tokyo, Japan

[73] Assignee: Nikko Co., Ltd., Tokyo, Japan

[21] Appl. No.: 669,505

[22] Filed: Mar. 12, 1991

[30] Foreign Application Priority Data

Mar. 15, 1990 [JP] Japan ..... 2-62733

[51] Int. Cl.[5] ..... A63H 17/34; A63H 5/00

[52] U.S. Cl. ..... 446/409; 446/456

[58] Field of Search ..... 446/409, 410, 456, 397; 273/86 B, 86 R

[56] References Cited

U.S. PATENT DOCUMENTS

| | | | |
|---|---|---|---|
| 4,219,962 | 9/1980 | Dankman et al. | 446/409 |
| 4,325,199 | 4/1982 | McEdwards | 446/409 X |
| 4,946,416 | 8/1990 | Stern et al. | 446/409 |
| 4,964,837 | 10/1990 | Collier | 446/409 |

OTHER PUBLICATIONS

Texas Instruments, *Linear Circuits Data Book* (1983), pp. 8-174 through 8-176 and 8-210 through 8-216.

*Primary Examiner*—Mickey Yu

*Attorney, Agent, or Firm*—Young & Thompson

[57] ABSTRACT

A sound effect device for radio controllable toy vehicles is capable of producing various realistic sounds such as a klaxon horn, an emergency braking sound, a small braking sound, and a tire-squealing sound upon sharp turning. The sounds are generated depending upon the driving condition of the toy vehicle, and the device is further capable of producing realistic sounds that are readily modified various types of toy vehicles. The device may have an engine sound on/off switch and a starting switch that causes production of a first engine sound which is thereafter varied based on the driving condition of the vehicle. Further, the device may generate certain sounds only upon simultaneous detection of two signals controlling the movements of the vehicle.

4 Claims, 3 Drawing Sheets

SOUND EFFECT DEVICE FOR RADIO CONTROLLABLE TOY VEHICLE

FIELD OF THE INVENTION

This invention relates to a sound effect device for a radio controllable toy vehicle which is motor-driven.

A sound effect device of such a type is disclosed in Japanese Utility Model publication No. 60-39040. The device is capable of producing a pseudo idling sound which is generated in a normal driving condition, and a realistic engine sound proportionate to the number of revolutions of a power drive unit such as a drive shaft or wheel, on the basis of a pulse signal corresponding to the number of revolutions of the power drive unit. However, in the device of the prior art, since the pulse signal is generated due to a change in the number of revolutions of the drive unit, realistic engine sounds such as an engine racing sound and various engine sounds generated upon gear-shifting can be produced when the number of revolutions is zero or not changed.

An improved sound effect device developed in order to eliminate the aforementioned problem is disclosed in Japanese Patent Laid-Open publication No. 62-277983. The device differs from the foregoing conventional one in employing a one-shot pulse generator provided on a transmitter and a controllor provided on a receiver for generating a realistic engine sound. The generator emits a neutral pulse signal so as to switch a driving condition of a toy vehicle between idling and running by shifting a change-over switch of the transmitter between ON- and OFF-positions, respectively. The controller controls the engine sound generation on the basis of the neutral pulse signal and a direct-current voltage signal proportionate to a number of revolutions of a motor depending upon a drive pulse signal.

The controller includes a voltage variable frequency circuit, wherein, when a driving codition of the toy vehicle is switched from idling to running vice versa, a direct current voltage is varied by integrating means so that a wave form of the varied voltage has saw-tooth shape. Depending upon the saw-tooth shape of the varied voltage and the neutral pulse signal, the controller generates realistic engine sounds such as an engine racing sound upon idling and engine acceleration and deceleration sounds upon gear-shifting.

However, the conventional improved device producing the aforementioned realistic engine sound consistent with a driving condition of the toy vehicle cannot generate a wide variety of realistic sounds such as a rotation sound of a starting motor, an engine acceleration sound, an idling sound, a tire-squealing sound upon sharp turning and a braking sound.

Moreover, in order to generate a special kind of sound such as a turbo engine sound, the conventional improved device is provided with an oscillator having a fixed frequency which emits a pulse corresponding to the sound. In addition, since the time constant of an integrating circuit should be changed in order to produce separate types of realistic sounds upon engine-racing or gear-shifting, the conventional improved device is also provided with a switch circuit for increasing or decreasing capacity which is necessary upon changing the time constant according to the driving condition of the toy vehicle. To this end, the conventional improved device has a complicated circuit constitution.

SUMMARY OF THE INVENTION

Accordingly, it is an object of the present invention to provide a sound effect device for a radio controllable toy vehicle capable of producing various realistic sounds such as a klaxon horn, an emergency braking sound, a small braking sound, a tire-squealing sound upon sharp turning which are generated depending upon a driving condition of the toy vehicle. Further, it is another object of the invention to provide a sound effect device capable of producing realistic sounds that are readily modified for various types of toy vehicles.

In order to realize the objects, the sound effect device of the invention is built in a radio controllable toy vehicle which includes a receptive circuit for receiving radio control signals, a decoder circuit for decoding the signals received in the receptive circuit, and a power-motor drive circuit and a steering drive circuit which respectively actuate a motor unit and a steering unit in accordance with a signal delivered from each of output terminals of the decoder circuit.

The device of the invention is built in a body thereof, with an engine sound on/off switch, a starting switch for energizing a starting motor, an amplifier, a speaker electrically connected to the amplifier, and a microcomputer. The engine sound on/off switch, the starting switch and the amplifier are electrically connected to the microcomputer. The microcomputer receives signals relative to a driving condition of the toy vehicle which are delivered from the decoder circuit and delivered by shifting the engine sound on/off switch and the starting switch. The microcomputer performs a processing for generating realistic sounds including engine sounds through the amplifier from the speaker depending upon the delivered signals.

When the engine sound on/off switch is shifted to START-position, the device of the invention subsequently produces a rotation sound of the starting motor, an engine acceleration sound and an idling sound. Then, when a FORWARD stick provided on a transmitter is moved to ON-position, a realistic engine sound is generated by the microcomputer processing while the toy vehicle moves in forward direction. Furthermore, when radio control signals are transmitted to the microcomputer by shifting sticks provided on the transmitter, various realistic sounds such as a high-speed engine sound, a tire-squealing sound upon sharp turning, and an emergency braking sound are produced depending upon the driving condition of the toy vehicle.

BRIEF DESCRIPTION OF THE DRAWINGS

Other aspects and advantages of the invention will become apparent from the following detailed description and the accompanying drawings illustrating by way of example the features of the invention, in which.

PREFERRED EMBODIMENTS OF THE INVENTION

Figure 1:
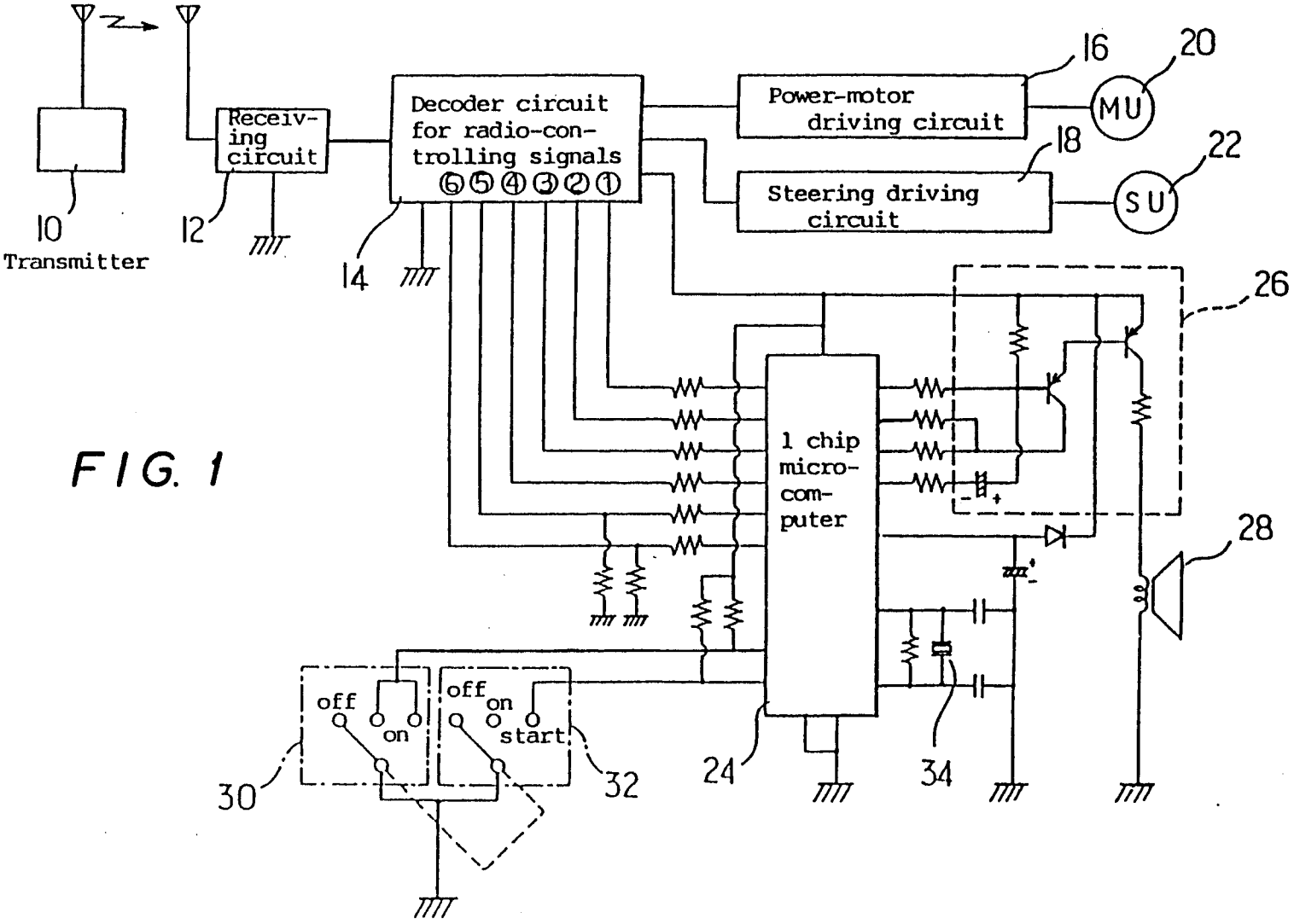
FIG. 1 is a circuit diagram of a sound effect device according to the present invention used as one embodiment in a radio controllable toy vehicle.

Referring to FIG. 1, a circuit diagram of a sound effect device used for a radio controllable toy vehicle shows a transmitter 10, a receptive circuit 12 for receiving a signal delivered from the transmitter 10, a decoder circuit 14 for generating a radio control signal, a power-motor drive circuit 16, a steering drive circuit 18, a motor unit 20, a steering unit 22, a 1-chip microcomputer 24, an amplifier 26, a speaker 28, an engine sound on/off switch 30 and a starting switch 32 for energizing a starting motor.

The receptive circuit 12 built in a radio controllable toy vehicle serves for receiving a signal delivered from the transmitter 10. The radio control signal received is delivered to the decoder circuit 14 and converted therein into separate signals for controlling the motor unit (MU) 20 and the steering unit (SU) 22. The signals converted are respectively transmitted to the power-motor drive circuit 16 and the steering drive circuit 18 so that the motor unit 20 and the steering unit 22 are actuated. Accordingly, the toy vehicle is controllably maneuvered in forward and backward directions and allowed to turn right and left by actuation of control sticks (not shown in the drawings) provided on the transmitter 10. The decoder circuit 14 includes a plurality of output terminals, for instance a right-turn signal output terminal (1), a left-turn signal output terminal (2), a reverse motion signal output terminal (3), a forward motion signal output terminal (4), a turbo signal output terminal (5) and a klaxon horn signal output terminal (6), which are respectively connected to the microcomputer 24. On the other hand, the engine sound on/off switch 30 and the starting switch 32 are connected to the microcomputer 24. Further, a speaker 28 is connected through an amplifier 26 to the microcomputer 24. When the engine sound on/off switch 30 is turned on, signals may be transmitted to the microcomputer 24 through the receptive circuit 12 and each of the output terminals of the decoder circuit 14. A sound effect processing is started by a program stored in ROM (not shown in the drawings) of the microcomputer 24 on the basis of the signal delivered from the output terminal. Namely, many kinds of sounds which simulate various driving conditions are realistically emitted in the speaker 28 of the toy vehicle.

The sound effect processing will be described hereinafter in detail by referring to FIGS. 1 to 5. FIGS. 2 to 5 are flow charts illustrating steps in the sound effect processing conducted by the microcomputer 24 according to a driving condition of the toy vehicle such as a racing car.

The sound effect processing is controlled by the microcomputer 24 as follows.

First, a main switch for power supply (not shown in the drawings) disposed on the toy vehicle is turned on. Then, the microcomputer 24 starts in SILENT mode in which no sound is generated. When the engine sound on/off switch 30 is shifted from OFF-position to ON-position as shown in FIG. 1, an engine-sound-ON input signal is transmitted to the microcomputer 24 so that a condition of the microcomputer 24 is changed from the SILENT mode to a standby mode for generating sounds in the speaker 28. The starting switch 32 is connected to the microcomputer 24 as well as the engine sound on/off switch 30, both of which are associatively connected to each other as shown in FIG. 1. Accordingly, when the engine sound on/off switch 30 is turned on, the starting switch 32 is associated with the switch 30 so as to be shifted from OFF-position to ON-position. However, even in case that the starting switch 32 is shifted to either ON-position or the OFF-position, no signal is transmitted to the microcomputer 24. Therefore, a processing for generating a rotation sound of a starting motor is not started and the microcomputer 24 is in the SILENT mode. In the case that the starting switch 32 is shifted to START-position, a START-ON signal is transmitted to the microcomputer 24. The microcomputer 24 which is connected through the amplifier 26 to the speaker 28 conducts a processing for generating the rotation sound of the starting motor. The rotation sound is generated in the speaker 28. When the rotation sound is generated four times, the microcomputer initiates a processing for generating an engine acceleration sound from the speaker 28. The starting switch 32 is allowed to be automatically shifted from the START-position to the ON-position when released from a pressure force by an operator. For this reason, when the starting switch 32 is shifted from the START-position to the ON-position before the rotation sound is generated four times, the engine sound is not generated and the SILENT mode starts again. In the event that no input signal is delivered from the transmitter after generation of the engine acceleration sound, the microcomputer 24 initiates a processing for generating an idling sound in the speaker 28. On the other hand, when an accelerator stick of the transmitter 10 is moved to ON-position, an engine-racing sound generation signal is transmitted to the microcomputer 24 so that an engine-racing sound is generated in the speaker 28. In the case of moving a KLAXON HORN stick of the transmitter 10 to ON-position, a klaxon horn sound generation signal is delivered through the receptive circuit 12 to a klaxon horn signal output terminal (6) of the decoder circuit 14. The signal is transmitted from the output terminal (6) to the microcomputer 24 so that a klaxon horn sound is generated in the speaker 28. After the horn sound generation, if a TURBO stick of the transmitter 10 is moved to ON-position, a processing B1 as shown in FIG. 3 for generating another kind of sound is started. In FIG. 3, when the TURBO stick is in ON-position and neither a LEFT-TURN stick nor a RIGHT-TURN stick of the transmitter 10 is not moved to ON-position, a high-speed forward signal is delivered from the decoder circuit 14 through the power-motor drive circuit 16 to the motor unit 20. The motor unit 20 is actuated to start forward movement of the toy vehicle at high speed. On the other hand, a high-speed engine sound generation signal is delivered from the turbo signal output terminal (5) of the decoder circuit 14 to the microcomputer 24. The microcomputer 24 initiates a processing for generating a high-speed engine sound in accordance with the signal delivered. In the case that the LEFT- or RIGHT-TURN stick is moved to the ON-position upon steering operation, a left- or right-turn signal is delivered from the decoder circuit 14 through the steering drive circuit 18 to the steering unit 22. The steering unit 22 is actuated to turn front wheels of the toy vehicle to the left or right. In the same case, a tire-squealing sound generation signal is transmitted to the microcomputer 24 from the right-turn signal output terminal (1) or the left-turn signal output terminal (2) of the decoder circuit 14. Then, the microcomputer 24 performs a processing for generating a tire-squealing sound upon sharp turning. Further, in the case that a REVERSE stick of the transmitter 10 is moved to ON-position upon high-speed forward driving while the TURBO stick is in the ON-position, a reverse signal is delivered from the decoder circuit 14 through the power-motor drive circuit 16 to the motor unit 20. The motor unit 20 is actuated to change a moving direction of the toy vehicle from forward to reverse. In the same case, an emergency braking sound generation signal is delivered from a reverse signal output terminal (3) of the decoder circuit 14 to the microcoputer 24. The microcomputer 24 initiates a processing for generating an emergency braking sound. If the REVERSE stick is in OFF-position in the same condition, a processing A1 shown in FIG. 2 is started.

Figure 2:
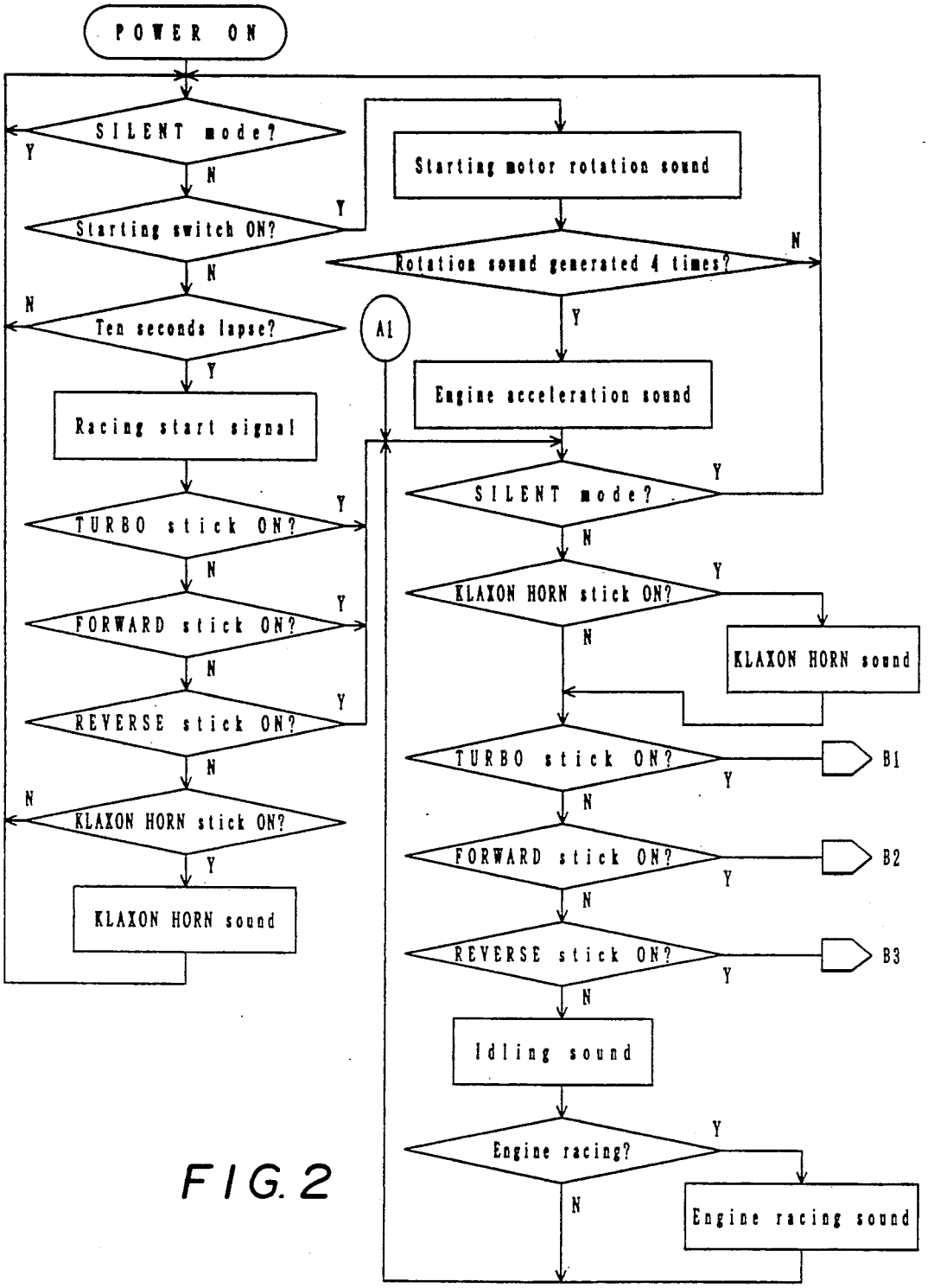
FIGS. 2 to 5 are flow charts illustrating each of steps in the sound effect processing for producing various realistic sounds, which is conducted by a 1-chip microcomputer shown in FIG. 1.
Figure 3:
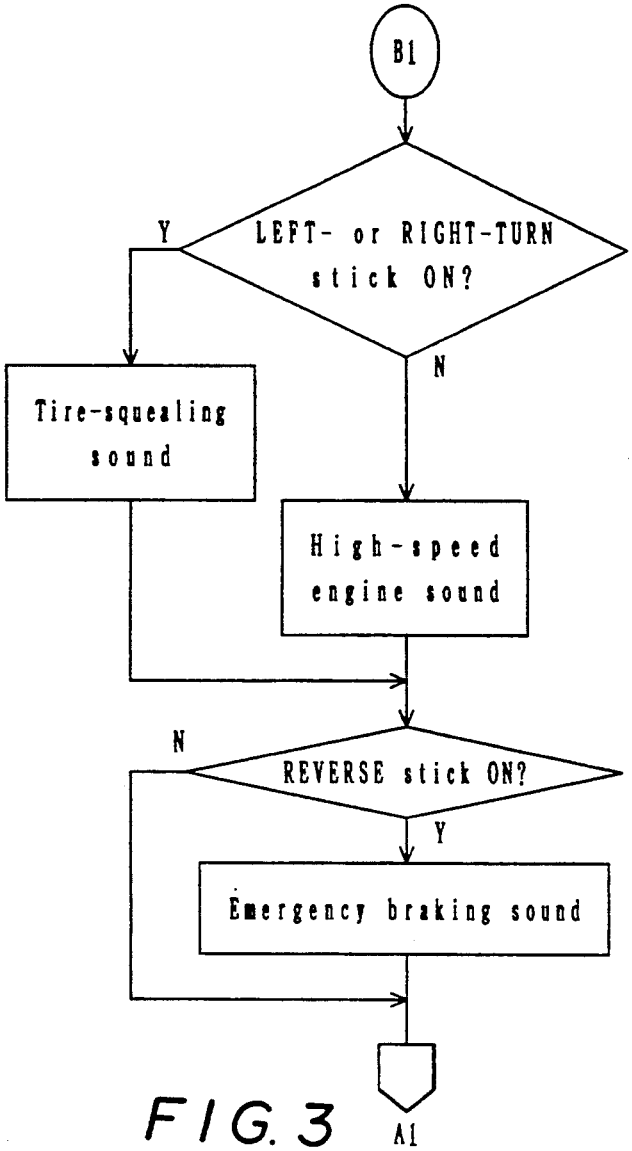
Figure 4:
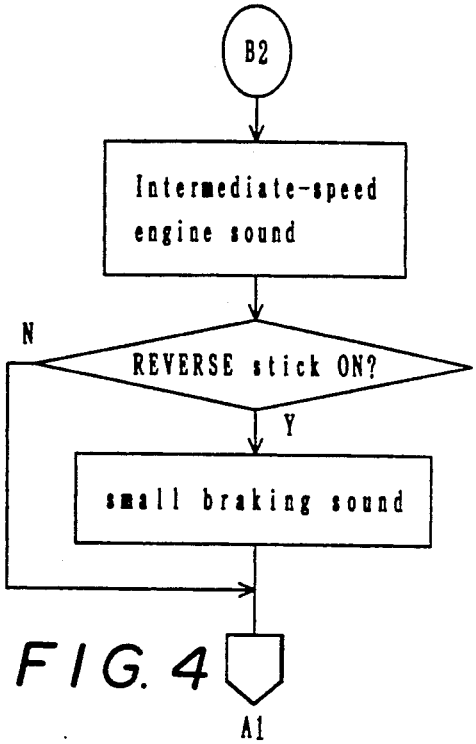
Figure 5:
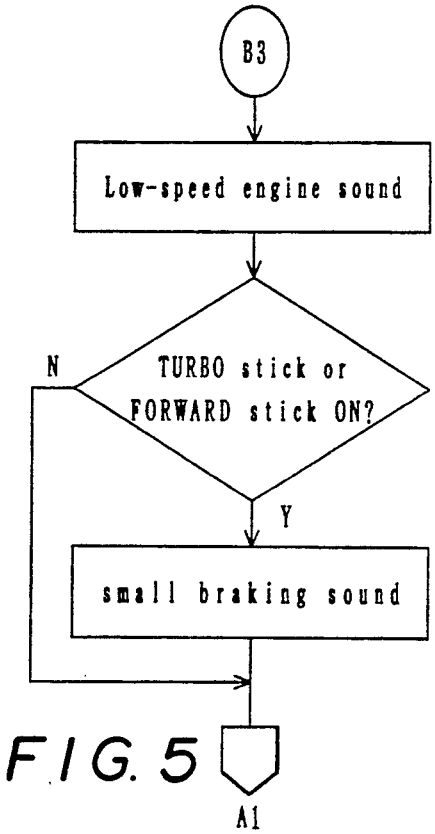

Further, in the case that a FORWARD stick of the transmitter 10 is moved to ON-position while the TURBO stick is not moved to the ON-position as shown in FIG. 2, an intermediate-speed forward signal is transmitted to the motor unit 20 through the receptive circuit 12, the decoder circuit 14 and the power-motor drive circuit 16. The motor unit 20 is actuated to start forward movement of the toy vehicle at intermediate speed. In the same case, an intermediate-speed engine sound generation signal is delivered from a forward signal output terminal (4) of the decoder circuit 14 to the microcomputer 24. The microcomputer 24 initiates a processing B2 for generating an intermediate-speed engine sound as shown in FIG. 4. If the REVERSE stick is moved to the ON-position during intermediate-speed driving, a reverse signal is transmitted to the motor unit 20 through the receptive circuit 12, the decoder circuit 14 and the power-motor drive circuit 16. The motor unit 20 is actuated to change a moving direction of the toy vehicle from forward to reverse. A small-braking sound generation signal is delivered from the reverse signal output terminal (3) to the microcomputer 24. Then, the microcomputer 24 performs a processing for generating a small braking sound. If the REVERSE stick is in the OFF-position in the same condition, the processing A1 shown in FIG. 2 is started.

At the aforementioned first step of the sound effect processing, namely when a condition of the microcomputer 24 is changed from the SILENT mode to the standby mode for generating sounds in the speaker 28 and the starting switch 32 is not shifted to the START-position as shown in FIG. 1, the microcomputer 24 initiates a processing for generating a racing start signal sound after ten seconds lapse. A toy vehicle movement signal is transmitted to the motor unit 20 through the receptive circuit 12, the decoder circuit 14 and the power-motor drive circuit 16 when any one of the TURBO, FORWARD and REVERSE sticks of the transmitter 10 is moved to the ON-position (see FIG. 2). The motor unit 20 is actuated to move the toy vehicle according to the transmitted signal. In the same condition, namely when the stick is moved to the ON-position, an engine sound generation signal is delivered from any one of the output terminals (5, 4, 3) of the decoder circuit 14 to the microcomputer 24. The microcomputer 24 performs a processing for generating the high-speed, intermediate-speed or low-speed engine sound depending upon the movement of the toy vehicle caused by the motor unit 20. In addition, the microcomputer 24 initiates a processing for generating the racing start signal sound, each time the starting switch 32 is not in the START-position for a given period and a condition of the microcomputer 24 is in the SILENT mode. Therefore, a racing start of the toy vehicle can be realistically simulated due to the generation of the racing start signal sound.

As illustrated in FIG. 1, the sound effect device of the invention described above includes the 1-chip microcomputer 24 to which a signal for generating a realistic sound depending upon the toy vehicle movement is delivered from the decoder circuit 14. The device of the invention is also provided with the engine sound on/off switch 30 and the starting switch 32 which are electrically and operatively associated with each other, an oscillator 34, an amplifier 26, the speaker 28 and a small number of resistors, capacity meters and diodes. Therefore, the device of the invention having such a simple circuitry constitution can be readily miniaturized. Moreover, various sound effects which is not limited to the description of the aforementioned embodiment, depending upon various driving conditions of the toy vehicle can be achieved only by modifying a sound-effects-generation control program stored in ROM (not shown in the drawings) of the microcomputer 24.

As is obvious in the foregoing preferred embodiment, the sound effect device for the radio controllable toy vehicle according to the present invention accomplishes the generation or simulation of a wide variety of realistic sounds such as the rotation sound of the starting motor, the engine-accelerating sound, the klaxon horn sound, the emergency braking sound, the tire-sqealing sound corresponding to steering operation.

In addition, the device of the present invention realizes the various sound effects depending upon the driving conditions of the toy vehicle by modifying the program stored in the microcomputer without any change in the circuitry constitution, resulting in ready utilization for various types of the toy vehicles.

The aforementioned detailed description on the preferred embodiment has been given for clearness of understanding only and no unnecessary limitations should be understood therefrom as some modifications will be obvious to those skilled in the art.

What is claimed is:

1. A sound effect device built in a radio controllable toy vehicle which includes a receiver circuit for receiving radio control signals, a decoder circuit for decoding the received signals, a power-motor drive circuit and a steering drive circuit which respectively actuate a motor unit and a steering unit depending upon a signal delivered from said decoder circuit, said receiver circuit being electrically connected through said decoder circuit to said power-motor drive circuit and said steering drive circuit, and engine sound on/off switch, a starting switch for generating a starting signal, an amplifier, a speaker electrically connected to said amplifier, and a microcomputer; said engine sound on/off switch, said starting switch and said amplifier being electrically connected to said microcomputer; said microcomputer performing a processing responsive to said starting signal for generating, in said speaker, various realistic sounds including engine sounds depending upon a driving condition of the toy vehicle on the basis of signals delivered from said decoder circuit and a position of each of said switches, wherein said microcomputer generates a first engine sound responsive to said starting signal and varies said first engine sound responsive to said signals delivered from said decoder circuit.

2. The device defined in claim 1 wherein said engine sound on/off switch is electrically and operatively associated with said starting switch so that, when the engine sound on/off switch is turned on, the starting switch is automatically moved to ON-position vice versa.

3. A radio-controlled toy vehicle having a remote radio transmitter and a built-in receiving circuit and sound effect device, wherein a decoder circuit is provided to convert the received radio signals into a plurality of controlling signals for effecting movements of the vehicle, said controlling signals being also used by said sound effect device to generate corresponding sound effects, wherein said sound effect device comprises a one-chip microcomputer receptive of said plurality of controlling signals, and wherein said microcomputer is adapted to generate a signal to produce a particular sound responsive to the simultaneous detection of two of said plurality of controlling signals.

4. The toy vehicle according to claim 3, wherein said sound effect device comprises switch means movable from an OFF position to an ON position, said switch means at said ON position causing said microcomputer to generate a first engine sound simulating an idling engine sound, said transmitter having means for generating low speed and high speed signals for advancing said vehicle at a lower speed and a relatively higher speed, as well as for generating a turning signal, said particular sound effect being generated responsive to simultaneous detection of said signals for higher speed advancement and turning.

* * * * *